United States Patent [19]

Lindstrom et al.

[11] 4,400,312

[45] Aug. 23, 1983

[54] SULFUR BASED METAL CLEANERS

[75] Inventors: Merlin R. Lindstrom; Rector P. Louthan; Gary D. Macdonell, all of Bartlesville, Okla.

[73] Assignee: Phillips Petroleum Company, Bartlesville, Okla.

[21] Appl. No.: 376,074

[22] Filed: May 7, 1982

[51] Int. Cl.[3] ..... C11D 3/26

[52] U.S. Cl. ..... 252/545; 252/156; 252/89.1; 252/549; 252/DIG. 4; 260/455 A; 549/88; 568/63

[58] Field of Search ..... 252/545, 549, 551, 391, 252/395, 105, 149, 151, 156, 158, 89.1, DIG. 4; 260/455 A; 549/88; 568/63

[56] References Cited

U.S. PATENT DOCUMENTS

| | | | |
|---|---|---|---|
| 3,297,718 | 1/1967 | Sander | 549/88 |
| 3,640,736 | 2/1972 | Warner et al. | 106/3 |
| 3,649,674 | 3/1972 | Hoyer et al. | 260/455 A |
| 3,741,834 | 6/1973 | Williams et al. | 252/542 |
| 3,847,942 | 11/1974 | Kellen et al. | 549/88 |
| 3,900,498 | 8/1975 | Dubs et al. | 549/88 |
| 3,940,488 | 2/1976 | Frohberger et al. | 260/455 A |
| 4,081,480 | 3/1978 | Evers et al. | 568/63 |

FOREIGN PATENT DOCUMENTS

| | | |
|---|---|---|
| 191873 | 4/1959 | Sweden . |

OTHER PUBLICATIONS

Reaction of 3-hydroxythietane, Chemical Abstract 72:21543f, vol. 72, 1970.

*Primary Examiner*—John E. Kittle
*Assistant Examiner*—Hoa Van Le

[57] ABSTRACT

A novel composition and process are provided for cleaning metallic surfaces. The cleaning composition comprises an effective amount of at least one sulfur containing compound selected from the group consisting of a dialkylamino dithiocarbamic acid, a mercapto alkanone, or a trimethylene ring sulfur compound.

19 Claims, No Drawings

SULFUR BASED METAL CLEANERS

This invention relates to the cleaning of metal surfaces.

The surface cleanliness of metal surfaces is known to influence the physical and chemical properties of that surface. The surfaces of most metallic materials are covered either by a metal oxide due to oxidation, organic residues from the annealing process, or protective oils applied during a fabrication process. It is known to those skilled in the art that it is advantageous to remove these materials from the metal surface prior to subsequent handling such as, for example, a coating processes in order to obtain the maximum benefit from the coating.

Cleaning of metal surfaces is a laborious task at best. Cleaning agents for metallic surfaces of various types have been suggested, such as grinding compounds containing abrasives, corrosive and toxic materials like acid, and sometimes a chemical additive which has not necessarily assisted the cleaning process. For example, high molecular weight long chain alkyl mercaptans have been used in such formulations. Unfortunately, as chemical additives, these mercaptans leave an objectionable greasy film on the surface of the metal. In addition, many of these compounds are malodorous.

Of course, the use of abrasives, generally is undesirable. The metal surface, must, perforce, be worn away to at least a slight extent, at each and every abrading. In time this depreciates the value of the article involved, particularly plated ones. The abrading itself, even with finely divided abrasives, tends to increase the total surface area of the metal exposed to the corrosion causing environment. The same is true when corrosive and toxic materials are used.

An effective class of cleaning agents is certainly to be desired to remove contamination from common metal surfaces such as brass, copper, and steel.

It is an object of this invention to provide novel compositions suitable for cleaning brass, copper, and steel surfaces. It is a further object of this invention to provide a process for the cleaning of brass, copper, and steel surfaces.

Other aspects, objects, and the several advantages of this invention will be obvious to one skilled in the art to which my invention most nearly pertains from the following description and from the appended claims.

In accordance with the present invention it has been discovered that certain sulfur containing compounds are unusually effective agents for the removal of contaminants from brass, copper and steel surfaces. More particularly, dialkylamino dithiocarbamic acids, mercapto alkanones, and trimethylene ring sulfur compounds have been found to be unusually effective cleaning agents for steel surfaces and the latter two effective cleaning agents for copper and brass.

The dialkylaminoalkyl dithiocarbamic acids useful within the context of this invention can be represented by the generalized formula

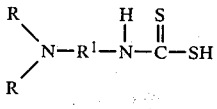

(I)

In this formula, R represents any alkyl group having 1 to 3 carbon atoms and $R^1$ represents an alkylene radical having 1 to 8 carbon atoms. Examples of these dialkylaminoalkyl dithiocarbamic acids include:

3-(N,N-Dimethylamino)methyl carbamic acid
3-(N,N-Dimethylamino)ethyl carbamic acid
3-(N,N-Dimethylamino)propyl carbamic acid
3-(N,N-Diethylamino)ethyl carbamic acid
3-(N,N-Diethylamino)methyl carbamic acid
3-(N,N-Diethylamino)hexyl carbamic acid
3-(N,N-Dipropylamino)ethyl carbamic acid
3-(N,N-Dipropylamino)propyl carbamic acid
3-(N,N-Dipropylamino)hexyl carbamic acid and the like.

The mercapto alkanones useful in the practice of this invention can be represented by the general formula:

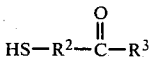

(II)

wherein $R^2$ represents any alkylene radical having 1 to 4 carbon atoms and $R^3$ represents an alkyl radical having 1 to 6 carbon atoms. Examples of these mercapto alkanones include:

mercaptomethyl methyl ketone
2-mercaptoethyl methyl ketone
2-mercaptoethyl ethyl ketone
3-mercaptopropyl ethyl ketone
4-mercaptobutyl hexyl ketone and the like.

Trimethylene ring sulfur compounds useful within the context of this invention can be represented by the generalized formula:

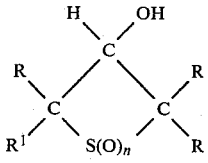

(III)

wherein R is defined above and n equals 0, 1, or 2. Examples of trimethylene ring sulfur compounds include:

3-hydroxytrimethylene sulfide
3-hydroxytrimethylene sulfoxide
3-hydroxytrimethylene sulfone and the like.

In the case of each type of compound indicated above (I, II, and III), a general maximum total number of carbon atoms per individual compound upper limit is dictated primarily by upper feasible solubility limits of the individual compounds in the applications and processes according to the present invention.

The three sulfur containing compounds of the present invention described above are well known and can be prepared by any method of preparation known to those skilled in the art. Dithiocarbamic acids are typically made by reacting an amine and carbon disulfide. Mercaptoalkanones can be derived from the reaction of a vinyl group and hydrogen sulfide in the presence of a free radical or UV light. Trimethylene sulfur compounds are typically the condensation product of reacting various methylene group-containing compounds one of which has a sulfur atom. In any event, any suitable method of preparation for making these compounds will suffice for using such in the present invention.

In the process of the present invention, the contaminated metal surface is cleaned by contacting the surface with an aqueous composition comprising an effective amount of at least one sulfur containing compound selected from the group described earlier. An effective amount of a sulfur containing compound is defined, for purposes of this invention, to be an amount of the particular sulfur containing compound present in the cleaning composition which is necessary to effectuate proper cleaning of the metal surface involved. It is contemplated in the present invention that the effective amount of sulfur containing compound needed will vary from composition to composition depending upon the other ingredients of the cleaning composition and the particular metallic surface to be cleaned.

Generally, the aqueous cleaning composition should comprise from about 80.0 to about 99.75 wt. % water and from about 0.25 to about 20.0 wt. % of at least one of the sulfur containing ingredients described above.

In a preferred embodiment of this invention, an effective amount of a Group IA or IIA metal hydroxide should be present in the cleaning composition. An effective amount of metal hydroxide, for the purposes of this invention, is defined to be that amount needed to be present in the cleaning composition to ensure proper cleaning of metallic surfaces. In general, when the metal hydroxide is present in a cleaning composition, the composition will comprise from about 85.0 to about 99.65 wt. % water, from about 0.1 to about 5.0 wt. % Group I or IIA metal hydroxide, and from about 0.25 to about 10.0 wt. % of at least one of the sulfur containing compounds earlier disclosed. Group IA or IIA metal hydroxides are preferred because they are water soluble and their presence has been found helpful in removing contaminants from metal surfaces.

In a further preferred embodiment of this invention, the use of an effective amount of a water soluble surfactant is encouraged. The use of a water soluble surfactant is preferred because it helps remove contaminants from metallic surfaces as well as forming an emulsion to prevent the return of these same contaminants back to metal surfaces. Any water soluble surfactant can be used in the present invention however, an anionic surfactant such as an alkyl, aryl sulfonate is typically used.

In the context of the present invention, an effective amount of a water soluble surfactant is defined to be that amount needed in a cleaning composition to effect homogeniety and proper cleaning of a metallic surface so as to remove contaminants. Generally, when the water soluble surfactant is present in a cleaning composition, the composition comprises from about 80.0 to 99.55 wt. % water, from about 0.1 to 5.0 wt. % water soluble surfactant, from about 0.1 to about 5.0 wt. % Group IA or IIA metal hydroxides, and from about 0.25 to about 10.0 wt. % of at least one of the three sulfur containing compounds.

Samples of metal, such as coupons, brass, copper and steel can be immersed in any type of agitated bath, such as an ultrasonic bath, consisting of the ingredients described above, i.e., water and at least one sulfur containing compound, a Group IA or IIA metal hydroxide, and a water soluble surfactant. This combination of metal coupons and cleaning solution can then be stirred and heated at any temperature and for any time suitable to effectuate proper cleaning. Typically the metals are heated in a cleaning solution at a temperature between about 70° to 200° F. for no longer than about 15 minutes. By the process of the present invention, the resulting metal surfaces should be substantially free of contaminants.

The following Examples further illustrate the present invention.

EXAMPLE I

This example serves to illustrate the operability of this invention when using dialkyl aminoalkyl dithiocarbamic acids as active ingredients in aqueous metal surface cleaning solutions. The example also demonstrates the procedure used to evaluate all of the active ingredients described herein. The test consists of immersing 1 inch×5 inches×0.400 inch steel, 1 inch×5 inches×0.035 inch brass, and 1 inch×5 inches×0.025 inch copper coupons into an aqueous cleaning solution containing 1 weight percent sodium hydroxide, or 1 weight percent surfactant (Triton X-202, sodium alkylaryl polyether sulfonate), or 2 weight percent of the active sulfur-based ingredient such as N,N-dimethyl-3-aminopropyl dithiocarbamic acid or combination of all three. The solutions were heated to 90° F., 140° F., or 190° F. and stirred in an ultrasonic bath. The uncleaned metal coupons were periodically removed from the bath, rinsed in running tap water, visually rated for appearance, and evaluated for cleanliness by the water break-free test. This test is discussed in Metal Finishing, 45 (12), pages 77, 78, 88 (1947), "Testing of Alkaline Metal Cleaners" by A. Mankowich and Organic Finishing, "Method of Evaluating Alkali Cleaners", 1946, page 9 by C. Nielson. Water break-free test means the surface remains water-wetted without breaking away. At this point the surface is considered clean. The surfaces were also examined for general cleaning in addition to water break-free. Using the procedure described, the compound 3-(N,N-dimethylamino)propyl dithiocarbamic acid was evaluated as an active ingredient in a cleaning solution. The data listed in Table I indicates the carbamic acid derivative is active in cleaning steel surfaces but not satisfactory in cleaning brass and copper surfaces. The data also indicates the carbamic acid compound is useful only when an alkali metal salt like sodium hydroxide and a surfactant like an alkyl aryl polyether sulfonate (Triton X-202) is present in the aqueous system.

TABLE I

EFFECT OF 3-(N,N—DIMETHYLAMINO)PROPYL DITHIOCARBAMIC ACID AS A CLEANING SOLUTION INGREDIENT

| | Minutes Till Cleaning and/or Break-Free[a] | | | | | |
|---|---|---|---|---|---|---|
| | Brass | | Copper | | Steel | |
| Cleaning Solution | 90° F. | 190° F. | 90° F. | 190° F. | 90° F. | 190° F. |
| Controls: | | | | | | |
| 1. 1% Aq. NaOH | ← | ← | NSC[b], Discolors | | → | → |
| 2. 1% Aq. Triton X-202[c] | ← | ← | NSC[b] Discolors | | → | → |
| 3. 1% AQ. NaOH, 1% Triton X-202 | ← | ← | NSC[b] Discolors | | → | → |
| 4. 2% Aq. DTCA[d] | NSC | NSC | 5 to 10 | 15 | NSC | NSC |
| 5. 1% Aq. NaOH, 2% DTCH[d] | ← | NSC | → | → | 15 | 10 |

TABLE I-continued

EFFECT OF 3-(N,N—DIMETHYLAMINO)PROPYL DITHIOCARBAMIC ACID AS A CLEANING SOLUTION INGREDIENT

| Cleaning Solution | Minutes Till Cleaning and/or Break-Free[a] | | | | | |
|---|---|---|---|---|---|---|
| | Brass | | Copper | | Steel | |
| | 90° F. | 190° F. | 90° F. | 190° F. | 90° F. | 190° F. |
| Inventive Run: | | | | | | |
| 6. 1% Aq. NaOH, 1% Triton X-202, 2% DTCA | ← | NSC | → | → | 3 | 5 |

[a]Break-free (bf) means surface remains water-wetted without breaking away.
[b]Means no significant cleaning after 15 minutes, the limit of the test.
[c]An anionic surfactant identified as an alkyl aryl polyether sulfonate from Rohm and Haas.
[d]3-(N,N—Dimethylamino)propyl Dithiocarbamic acid $(CH_3)_2NCH_2CH_2CH_2NHC(S)SH$

EXAMPLE II

This example illustrates the usefulness of acyclic mercapto ketones as active ingredients in aqueous metal surface cleaning solutions. The procedure described in Example I was repeated except 2-mercaptoethyl methyl ketone was used as the active ingredient. The results indicated significant cleaning and break-free time was obtained when the mercaptoketone, sodium hydroxide and Triton X-202 were used in combination. No cleaning or break-free time was obtained when the ingredients were used singularly. The results are listed in Table II.

TABLE II

EFFECT OF 2-MERCAPTOETHYL METHYL KETONE AS A CLEANING SOLUTION INGREDIENT
2 Wt. % 2-Mercaptoethyl Methyl Ketone[a]
1 Wt. % Sodium Hydroxide
1 Wt. % Triton X-202[b]
96 Wt. % Water

| Immersion Temp. °F. | Minutes Till Cleaning and/or Break-Free[c] | | |
|---|---|---|---|
| | Brass | Copper | Steel |
| 90 | 1 to 3 | 3 | 3 |
| 140 | 1 to 3 | 3 | 1 |
| 190 | 1 to 3 | 1 to 3 | 1 |

[a]Also known as 4-mercapto-2-butanone.
[b]An alkyl aryl polyether sulfonate from Rohm and Haas.
[c]Break-free means surface remains water-wetted without breaking away.

EXAMPLE III

This example illustrates the usefulness of cyclic sulfide sulfones and sulfoxides as active ingredients in aqueous metal surface cleaning solutions. The procedures described in Example I were repeated except the active carbamic acid ingredient was replaced with either one of three cyclic compounds, namely, 3-hydroxytrimethylene sulfide, 3-hydroxytrimethylene sulfoxide, and 3-hydroxytrimethylene sulfone. The results listed in Table III show these cyclic compounds as active ingredients for cleaning metal surfaces, particularly steel. The cyclic sulfides by themselves without sodium hydroxide or surfactant were not particularly active.

TABLE III

EFFECT OF CYCLIC SULFIDES, SULFOXIDES, SULFONES AS AQUEOUS CLEANING SOLUTION INGREDIENTS
2 Wt. % Cyclic Sulfur-Containing Compounds
1 Wt. % Sodium Hydroxide
1 Wt. % Triton X-202[a]
96 Wt. % Water

| Surface | Immersion Temp. °F. | Minutes Till Cleaning and/or Break-free[b] | | |
|---|---|---|---|---|
| | | Sulfide[c] | Sulfoxide[d] | Sulfone[e] |
| Brass | 90 | 5 | 5 | 10 |
| | 140 | 3 | 5 | 10 |

TABLE III-continued

EFFECT OF CYCLIC SULFIDES, SULFOXIDES, SULFONES AS AQUEOUS CLEANING SOLUTION INGREDIENTS
2 Wt. % Cyclic Sulfur-Containing Compounds
1 Wt. % Sodium Hydroxide
1 Wt. % Triton X-202[a]
96 Wt. % Water

| Surface | Immersion Temp. °F. | Minutes Till Cleaning and/or Break-free[b] | | |
|---|---|---|---|---|
| | | Sulfide[c] | Sulfoxide[d] | Sulfone[e] |
| | 190 | 1 | 1 | 10 |
| Copper | 90 | 5 | 10 | 3 |
| | 140 | 5 | 3 | 3 |
| | 190 | 3 | 1 | 3 |
| Steel | 90 | .5 | 5 | .5 |
| | 140 | .5 | 3 | .5 |
| | 190 | .5 | 3 | .5 |

[a]An alkyl aryl polyether sulfonate from Rohm and Haas.
[b]Break-free means surface remains water-wetted without breaking away.
[c]3-Hydroxytrimethylene sulfide (3-thietanol).
[d]3-Hydroxytrimethylene sulfoxide (3-thietanol-1-oxide).
[e]3-Hydroxytrimethylene sulfone (3-thietanol-1,1-dioxide).

SUMMARY

The data herein disclosed is summarized in Table IV. The most effective active ingredient materials appears to be the cyclic sulfides followed by the cyclic sulfoxides, mercaptoalkanones, cyclic sulfones and finally the dialkylaminoalkyl carbamic acids. The latter type compounds appear to be active only on steel surfaces.

TABLE IV

SUMMARY
2 Wt. % Active Ingredient
1 Wt. % Sodium Hydroxide
1 Wt. % Surfactant (Triton X-202)
96 Wt. % Water

| Example | Active Ingredients | Minutes Till Cleaning and/or Break-free at 90° F. to 190° F. | | |
|---|---|---|---|---|
| | | Brass | Copper | Steel |
| I | 3-(N,N—Dimethylamino)propyl carbamic acid | >15 | >15 | 3 |
| II | 2-Mercaptoethylmethyl Ketone | 1 to 3 | 1 to 3 | 1 to 3 |
| III | 3-Hydroxytrimethylene Sulfide | 1 to 5 | 3 to 5 | 0.5 |
| III | 3-Hydroxytrimethylene Sulfoxide | 1 to 5 | 1 to 10 | 3 |
| III | 3-Hydroxytrimethylene Sulfone | 10 | 3 | 0.5 |

Reasonable variations and modifications are possible in the scope of the foregoing disclosure and the appended claims.

We claim:

1. A composition suitable as a metallic cleaning agent comprising water and effective amounts of either a Group IA or IIA metal hydroxide and at least one sulfur containing compound selected from the group consisting of a dialkylaminoalkyl dithiocarbamic acid represented by:

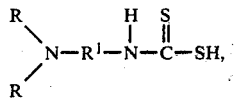

and a mercapto alkanone

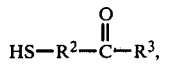

and a trimethylene ring sulfur compound represented by

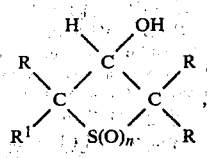

wherein R represents any alkyl group having 1 to 3 carbon atoms, $R^1$ and $R^2$ represent any alkylene radical having 1–8 and 1–4 carbon atoms each respectively, $R^3$ represents any alkyl radical having 1 to 6 carbon atoms, and n equals 0, 1, or 2.

2. A composition as in claim 1 further comprising an effective amount of a surfactant.

3. A composition as in claim 2 wherein said dialkylaminoalkyl dithiocarbamic acid is 3-(N,N-dimethylamino)propyl carbamic acid.

4. A composition as in claim 2 wherein said mercaptoalkanone is 2-mercaptoethyl methyl ketone.

5. A composition as in claim 2 wherein said trimethylene ring sulfur compound is one selected from the group consisting of either 3-hydroxytrimethylene sulfide, 3-hydroxytrimethylene sulfoxide, or 3-hydroxytrimethylene sulfone.

6. A composition suitable as a metallic cleaning agent comprising from about 85.0 to about 99.65 wt. % water, from about 0.1 to about 5.0 wt. % Group IA or IIA metal hydroxide, and from about 0.25 to about 10.0 wt. % of at least one sulfur containing compound selected from the group consisting of a dialkylaminoalkyl dithiocarbamic acid represented by:

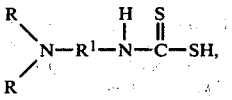

and a mercapto alkanone represented by

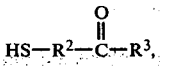

and a trimethylene ring sulfur compound represented by

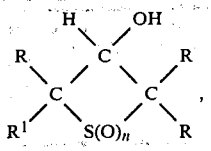

wherein R represents any alkyl group having 1 to 3 carbon atoms, $R^1$ and $R^2$ represent any alkylene radical having 1–8 and 1–4 carbon atoms each respectively, $R^3$ represents any alkyl radical having 1 to 6 carbon atoms, and n equal 0, 1, or 2.

7. A composition as in claim 6 further comprising from about 80.0 to 99.55 wt. % water, from about 0.1 to 5.0 wt. % surfactant, from about 0.1 to about 5.0 wt. % Group I or IIA metal hydroxide, and from about 0.25 to about 10.0 wt. % of said at least one sulfur containing compound.

8. A composition as in claim 7 wherein said dialkylamino alkyl dithiocarbamic acid is 3-(N,N-dimethylamino)propyl carbamic acid.

9. A composition as in claim 7 wherein said mercaptoalkone is 2-mercaptoethyl methyl ketone.

10. A composition as in claim 7 wherein said trimethylene ring sulfur compound is one selected from the group consisting of either 3-hydroxytrimethylene sulfide, 3-hydroxytrimethylene sulfoxide, or 3-hydroxytrimethylene sulfone.

11. A process for cleaning metallic steel surfaces which comprises bringing said metallic steel surfaces into contact with a composition comprising water, and effective amounts of at least one Group IA or IIA metal hydroxide and at least one sulfur containing compound selected from the group consisting of a dialkylaminoalkyl dithiocarbamic acid represented by:

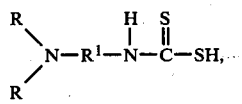

and a mercapto alkanone represented by

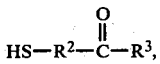

and a trimethylene ring sulfur compound represented by

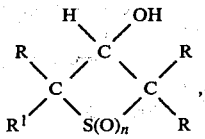

wherein R represents any alkyl group having 1 to 3 carbon atoms, $R^1$ and $R^2$ represent any alkylene radical having 1–8 and 1–4 carbon atoms each respectively, $R^3$ represents any alkyl radical having 1 to 6 carbon atoms, and n equals 0, 1, or 2.

12. A process as in claim 11 comprising bringing said metallic steel surfaces into contact with a composition comprising an effective amount of a surfactant.

13. A process for cleaning metallic steel surfaces which comprises bringing said metallic steel surfaces into contact with a composition comprising from about 85.0 to about 99.65 wt. % water, from about 0.1 to about 5.0 wt. % of Group IA or IIA metal hydroxide, and from about 0.25 to about 10.0 wt. % of at least one sulfur containing compound selected from the group consisting of a dialkylaminoalkyl dithiocarbamic acid represented by:

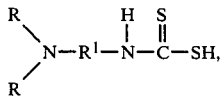

and a mercapto alkanone represented by

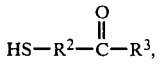

and a trimethylene ring sulfur compound represented by

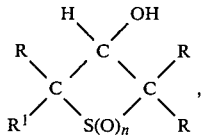

wherein R represents any alkyl group having 1 to 3 carbon atoms, $R^1$ and $R^2$ represents any alkylene radical having 1–8 and 1–4 carbon atoms each respectively, $R^3$ represents any alkyl radical having 1 to 6 carbon atoms, and n equals 0, 1, or 2.

14. A process as in claim 13 comprising bringing said metallic steel surfaces into contact with a composition comprising from about 80.0 to 99.55 wt. % water, from about 0.1 to 5.0 wt. % surfactant, from about 0.1 to about 5.0 wt. % Group I or IIA metal hydroxide, and from about 0.25 to about 10.0 wt. % of said at least one sulfur containing compound.

15. A process for cleaning of brass and copper metal surfaces which comprises bringing said brass and metallic copper surfaces into contact with a composition comprising water, and an effective amount of a Group IA or IIA metal hydroxide and at least one sulfur containing compound selected from the group consisting of a mercapto alkanone represented by

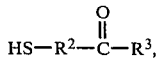

and a trimethylene ring sulfur compound represented by

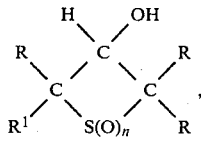

wherein R represents any alkyl group having 1 to 3 carbon atoms, $R^2$ represents any alkylene radical having 1 to 4 carbon atoms, $R^3$ represents any alkyl radical having 1 to 6 carbon atoms, and n equals 0, 1, or 2.

16. A process as in claim 15 comprising bringing said copper and brass metallic surfaces into contact with an aqueous composition comprising an effective amount of a Group IA and IIA metal hydroxide, a surfactant and said at least one sulfur containing compound.

17. A process for cleaning brass and copper metallic surfaces comprising bringing said brass and copper metallic surfaces into contact with a composition comprising from about 85.0 to about 99.65 wt. % water, from about 0.1 to about 5.0 wt. % Group IA or IIA metal hydroxide, and from about 0.25 to about 10.0 wt. % of at least one sulfur containing compound selected from the group consisting of a mercapto alkanone represented by

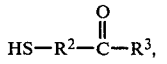

and a trimethylene ring sulfur compound represented by

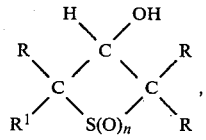

wherein R represents an alkyl group having 1 to 3 carbon atoms, $R^2$ represents any alkylene radical having from 1 to 4 carbon atoms, $R^3$ represents any alkyl radical having 1 to 6 carbon atoms, and n equals 0, 1, or 2.

18. A process as in claim 17 comprising bringing said brass and copper metallic surfaces into contact with a composition comprising from about 80.0 to 99.55 wt. % water, from about 0.1 to 5.0 wt. % surfactant, from about 0.1 to about 5.0 wt. % Group I or IIA metal hydroxide, and from about 0.25 to about 10.0 wt. % of said at least one sulfur containing compound.

19. A process according to claim 18 wherein said metal hydroxide is sodium hydroxide.

* * * * *